US007478459B2

(12) United States Patent
Kawaguchi et al.

(10) Patent No.: US 7,478,459 B2
(45) Date of Patent: Jan. 20, 2009

(54) BUCKLE

(75) Inventors: Gaku Kawaguchi, Yokohama (JP); Ki-Po Sim, Cheonan-si (KR)

(73) Assignee: NIFCO Inc., Yokahama-Shi, Kanagawa (JP)

( * ) Notice: Subject to any disclaimer, the term of this patent is extended or adjusted under 35 U.S.C. 154(b) by 0 days.

(21) Appl. No.: 11/723,027

(22) Filed: Mar. 16, 2007

(65) Prior Publication Data

US 2007/0240286 A1 Oct. 18, 2007

(30) Foreign Application Priority Data

Apr. 4, 2006 (JP) ..... 2006-103152
Nov. 13, 2006 (JP) ..... 2006-307007

(51) Int. Cl.
*A44B 11/12* (2006.01)

(52) U.S. Cl. ..... 24/170

(58) Field of Classification Search ..... 24/170, 24/191, 712.6, 133, 134 R, 134 KB, 134 L, 24/197, 193, 163 R
See application file for complete search history.

(56) References Cited

U.S. PATENT DOCUMENTS 4,614,007 A * 9/1986 Else ..... 24/136 K
5,469,583 A * 11/1995 Akeley et al. ..... 2/421
D559,146 S * 1/2008 Kawaguchi ..... D11/216

FOREIGN PATENT DOCUMENTS

| | | | |
|---|---|---|---|
| CH | 602033 A5 * | 7/1978 | |
| JP | S55-14249 | 4/1980 | |
| JP | S61-5114 | 1/1986 | |
| JP | S63-140207 | 9/1988 | |

* cited by examiner

*Primary Examiner*—James R Brittain
(74) *Attorney, Agent, or Firm*—Manabu Kanesaka

(57) ABSTRACT

A buckle arranged to connect a band member to a connected member includes a base having an attaching portion for the connected member, a base portion, and opposing lever member supporting portions projecting from the base portion. A lever member is rotatably attached to the base, and includes a combined portion and an operating portion extending from the combined portion. The operating portion includes a slit through which the band member is allowed to pass. The lever member further includes a clamping portion protruding from the combined portion in a direction different from the operating portion. The clamping portion is configured to clamp the band member, which passes between the base portion and the combined portion, to the base portion by a rotation of the lever member towards the base.

4 Claims, 11 Drawing Sheets

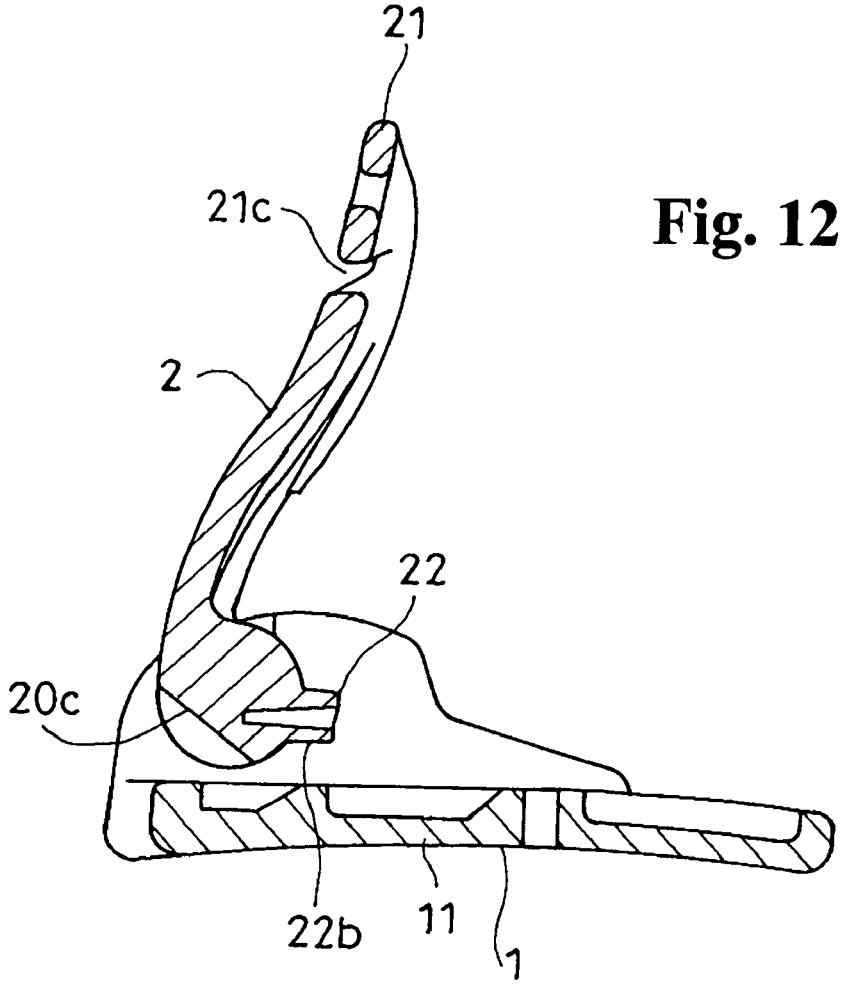
Fig. 12
Fig. 13
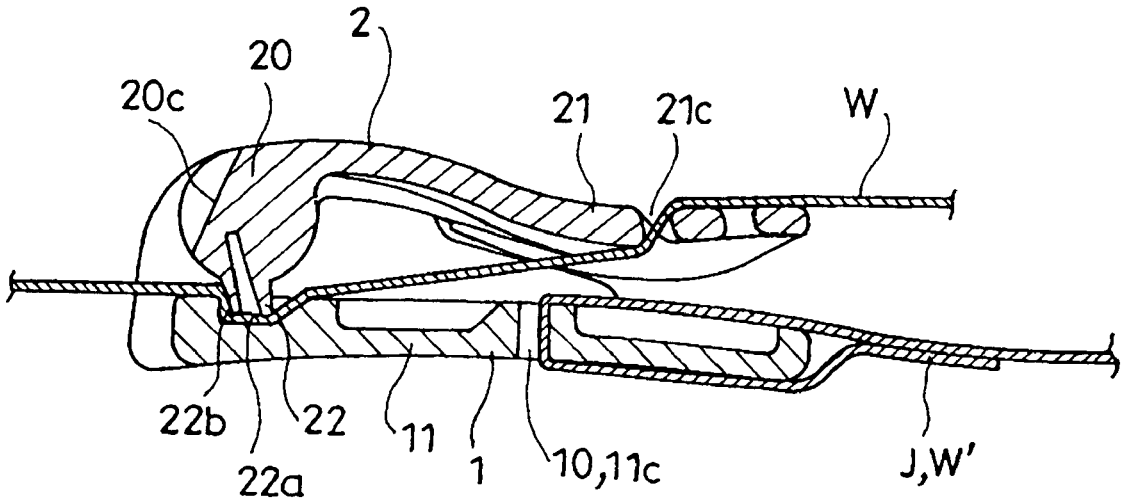

BUCKLE

BACKGROUND OF THE INVENTION AND RELATED ART STATEMENT

The invention relates to the improvement of a buckle used for connecting a band member to a connected member, such as another band member, so that the fastened position is adjustable.

Buckles, such as those shown in Japanese Utility Model Publication No. 63-140207, comprise a buckle main body and a stopper piece attached to the buckle main body in such a way as to be rotatable. The buckle main body includes a pair of side plates and a bottom plate disposed between the pair of side plates. The stopper piece is bent at a predetermined angle through a bearing part, and one side is an operating plate portion and the other side is a locking cam portion. The stopper piece includes shafts on both sides of the bearing part, and is attached to the buckle main body in such a way as to be rotatable by inserting the shafts into shaft holes respectively formed in the pair of side plates of the buckle main body.

In the above-mentioned buckle, a belt can be passed between the bottom plate of the buckle main body and the outside of the bearing part of the stopper piece in a state wherein the stopper piece is stood up. By laying the stopper piece down from the state wherein the belt is passed through as mentioned above, the belt is clamped by the bottom plate of the buckle main body and the locking cam portion of the stopper piece, thereby fastening the belt.

In the above-mentioned buckle, when the fastened position of the belt is adjusted, the passed-through belt is moved to a desired position in the length direction of the belt while the stopper piece is stood up, after which the stopper piece must be laid down again. Consequently, the adjustment of the buckle requires both hands of an operator. Furthermore, if tension acts on the belt when the stopper piece is stood up, the belt may unpredictably slip through between the buckle main body and stopper piece.

In this kind of buckle including this sort of base and a lever member rotatably attached to the base, the band member passing between the base and lever member in the state that the lever member is stood up by rotating is clamped by laying the lever member down, thereby fastening the band member. The buckle may slip between the base and lever member when the lever member is stood up.

The present invention has been made such that the buckle prevents the band member from unpredictably slipping between the base and lever member when the lever member is stood up, and also, the lever member can be laid down by one hand.

Further objects and advantages of the invention will be apparent from the following description of the invention.

SUMMARY OF THE INVENTION

In order to achieve the objects described above, according to the present invention, a buckle includes the following structures of (1)~(7).

(1) A buckle for allowing a band member to connect to a connected member.

(2) The buckle includes a base with an attaching portion of the connected member.

(3) The buckle includes a lever member combined to the base to be rotatable.

(4) The base includes a base portion and a supporting portion of the lever member projecting from the base.

(5) The lever member includes an operating portion extending from a combined portion to the base and a clamped portion protruding from the combined portion in a direction different from the operating portion.

(6) The band member passes between the base portion of the base and the combined portion of the lever member in the state wherein the lever member is stood up. The band member is then clamped by the clamping portion of the lever member and the base portion of the base by rotating and laying the lever member down.

(7) Also, a slit is formed in the operating portion of the lever member that allows the band member, which is long in the rotational shaft line direction of the lever member, to pass through.

The band member which is passed through the buckle between the lever member and base from the state wherein the lever member is stood up, is pulled out from the inner face side of the operating portion to the outer face side of the operating portion through the slit provided in the operating portion. As described above, the lever member is laid down from the state wherein the band member is pulled out, thereby clamping and fastening the band member between the clamping portion and base portion of the base. This fastened state is released by re-standing up the lever member.

However, even at this time, the band member can be extended outward from the outer face side of the operating portion through the slit. when a force in the direction of slipping through the slit acts on the band member, or a force in the direction of allowing the band member to slip through the slit acts on the buckle, or the above-mentioned forces act on both the band member and buckle, the band member makes contact with the protruded end of the clamping portion, an edge portion of the inner surface side of the operating portion in the slit, and an edge portion of an outer surface side of the operating portion in the slit.

As a result of the above-mentioned forces acting on the band member when the lever member is stood up, a force in the direction of laying down the lever member acts on the lever member. By the action of this force, the lever member is rotated through at least a predetermined angle toward the position wherein the lever member is laid down. Accordingly, when the lever member is rotated, the band member is clamped between the protruded end of the clamping portion and the base portion of the base. As a result, the band member is prevented from slipping through between the lever member and base, and the band member and buckle are never unpredictably separated. Also, by holding the band member, which is pulled out of the slit and moving the pulled-out portion closer to the base portion of the base, the lever member is rotated to the position wherein the lever member is laid down by one hand, and the buckle may be fastened to the band member by the flip of a switch.

If the slit is formed in an arc shape in the length direction, the edge portion of the slit can be firm contact with the central part of the band member, which is tensed by the force in either one of the inner surface side and the outer surface side of the operating portion. Also, in the other side of the inner surface side and the outer surface side of the operating portion, the slit can be strongly contacted with the marginal portion side of the band member which is tensed as mentioned above.

If the face of the place wherein the slit of the operating portion of the lever member is formed, has a curved face as the curved center of the central part of the slit, the marginal portion of the slit can be strongly contacted with the central part of the band member which is tensed by the force in either the inner surface side and the outer surface side of the operating portion. Also, on the other side of the inner surface side and the outer surface side of the operating portion, the slit can make firm contact with the edge portion of the band member, which is tensed as mentioned above.

If two slits allowing the band member (which is long in the rotational shaft line direction of the lever member) to pass through are formed in the operating portion of the lever member with an space in the protruding direction of the operating portion, the band member passed through between the lever member and base is passed through one of the two slits from the inner surface side of the operating portion of the lever member, and is pulled out towards the outer surface side of the operating portion. After that, the band member can be re-pulled out to the inner surface side of the operating portion through another of the slits. Even in this case, the lever member, which is stood up when the force is acted, is rotated in the direction of being laid down, so that the band member can be prevented from slipping through between the lever member and base.

In the state wherein the lever member is laid down, the rotational center of the lever member is located on the upper side of the clamping portion, and is lopsidedly inclined toward the opposite side of the extended side of the operating portion rather than the position right above the clamping portion. As a result, in the state wherein the lever member is stood up, a space as large as possible is formed to allow the band member to pass through, between the base portion of the base and the combined portion of the lever member. At the same time, in the state wherein the lever member is laid down, the band member passes through by narrowing an interval between the clamping portion and base portion of the base, and may be solidly clamped between both the clamping portion and base portion of the base.

Because the band member passed between the base and lever member is additionally passed through the slit of the operating portion of the lever member, when the lever member is stood up, the clamping portion of the lever member and edge portion of the slit may be contacted with the band member by changing the position of the clamping portion of the lever member and the edge portion of the slit. Accordingly, when tension acts on the band member, rotating the stood-up lever member in the direction of making the lever member lay down prevents the band member from unpredictably slipping through between the base and lever member. Furthermore, the lever member can be laid down by one hand by using the band member pulled out through the slit.

BRIEF DESCRIPTION OF THE DRAWINGS

FIG. 12 is a sectional view taken along line 12-12 in FIG. 7;

FIG. 13 is a sectional view illustrating a used state of the buckle;

DETAILED DESCRIPTION OF PREFERRED EMBODIMENTS

Hereunder, preferred embodiments of the invention will be explained with reference to FIGS. 1~16.

Figure 1:
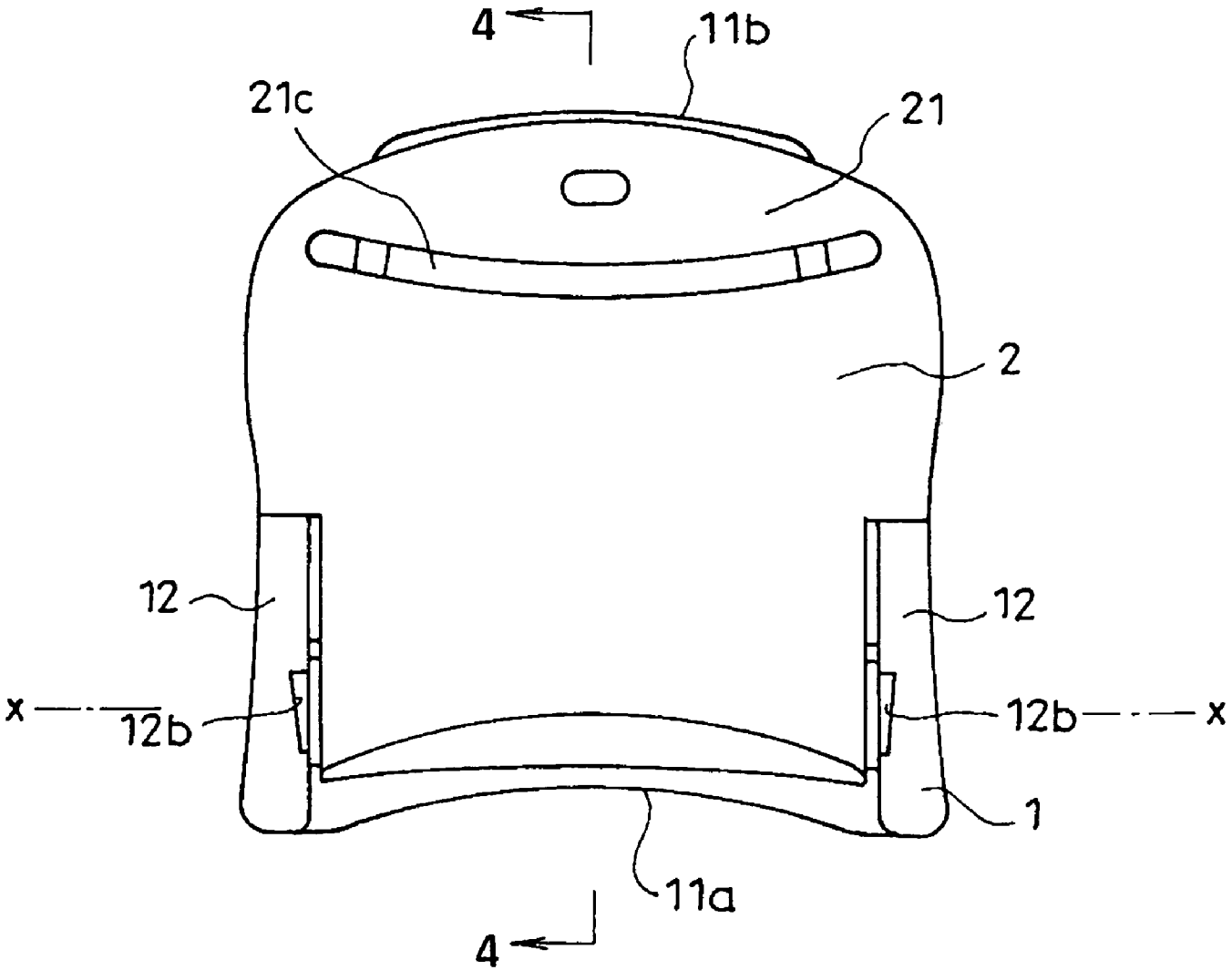
FIG. 1 is a plan view of a buckle.
Figure 2:
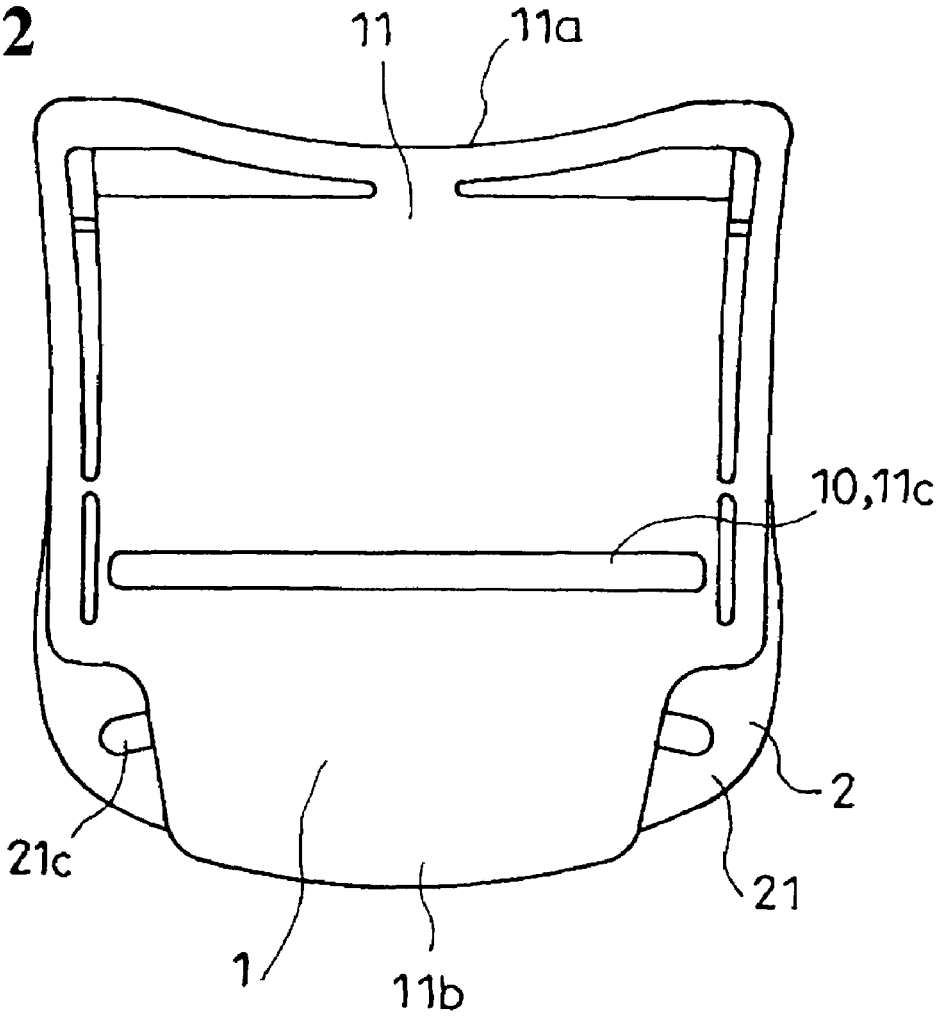
FIG. 2 is a bottom plan view of the buckle.
Figure 3:
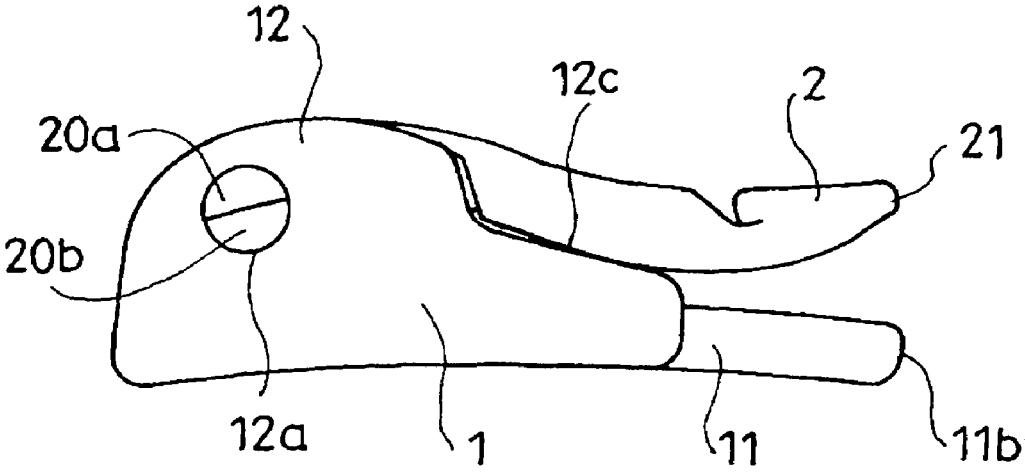
FIG. 3 is a right side view of the buckle.
Figure 4:
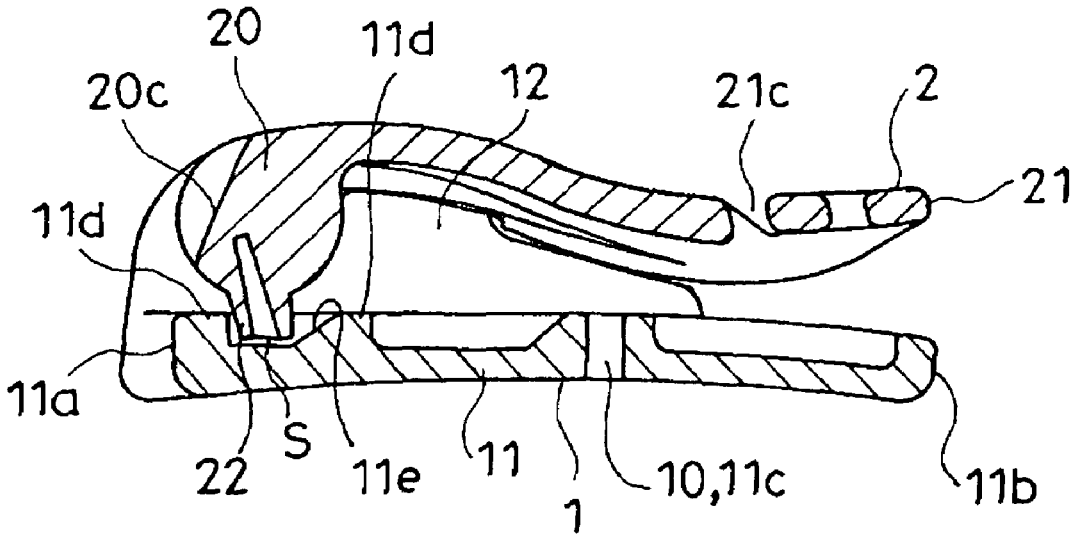
FIG. 4 is a sectional view taken along line 4-4 in FIG. 1.
Figure 5:
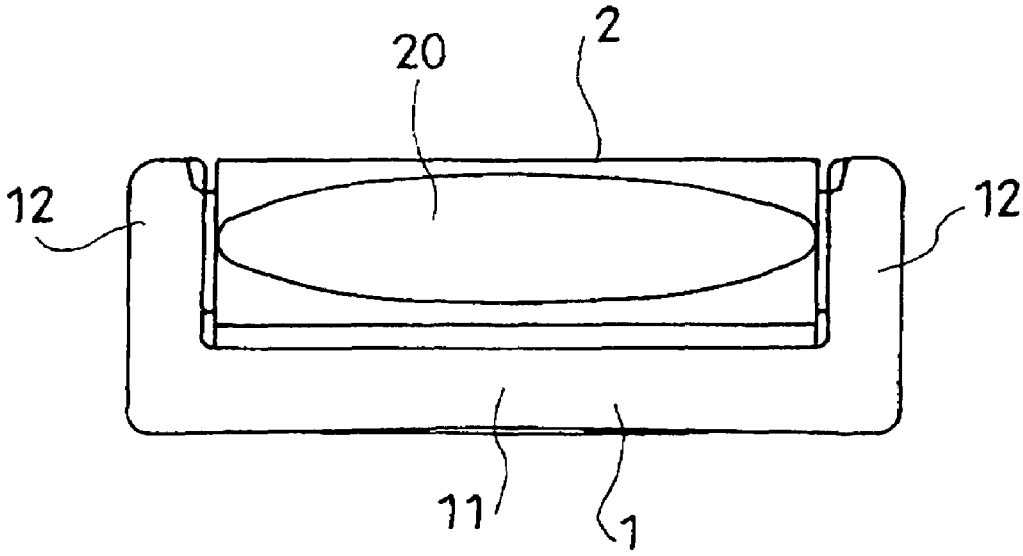
FIG. 5 is a front view of the buckle.
Figure 6:
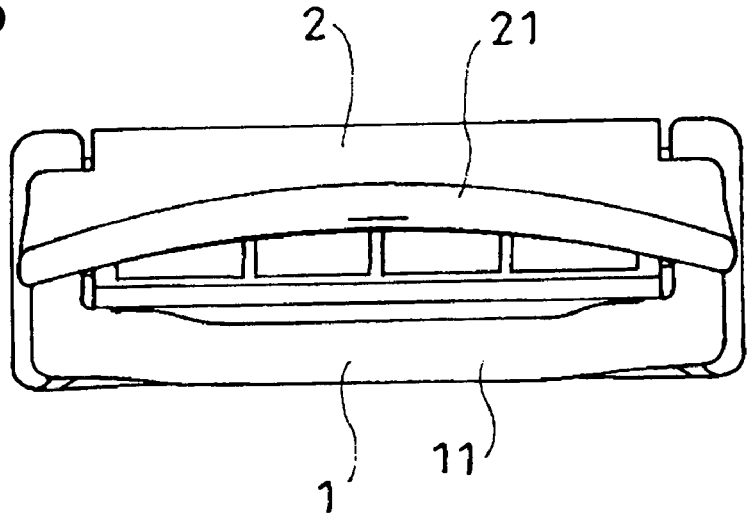
FIG. 6 is a rear view of the buckle.
Figure 7:
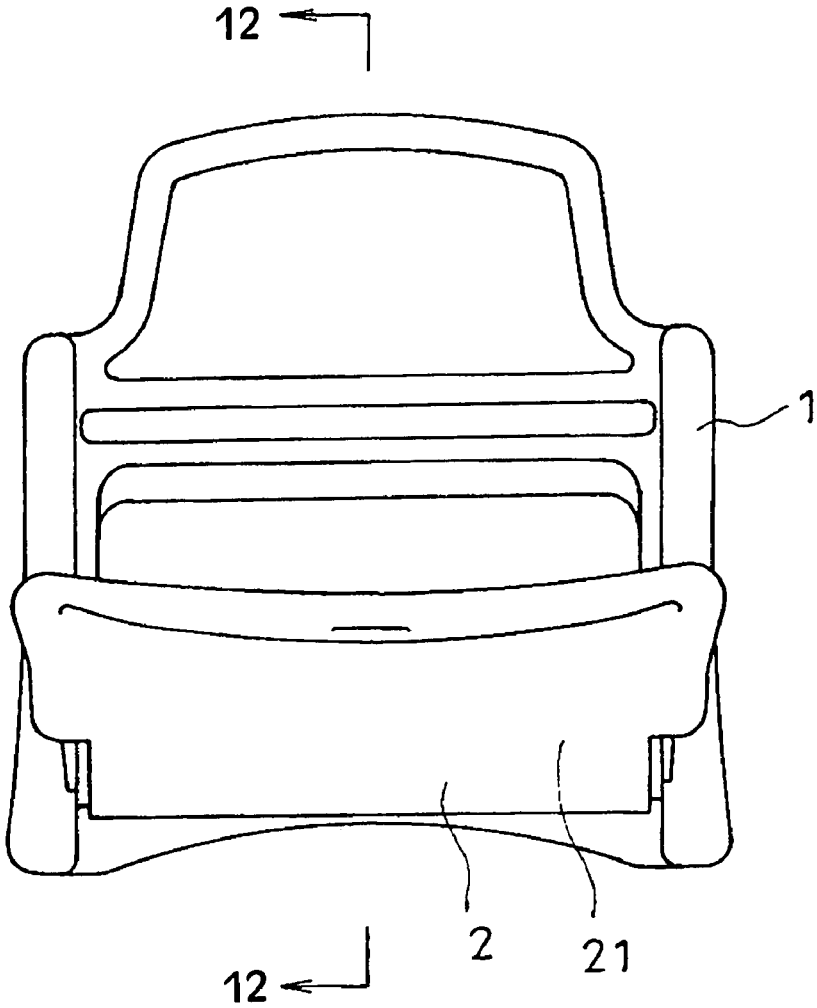
FIG. 7 is a plan view of the buckle in a state wherein a lever member 2 is stood up.
Figure 8:
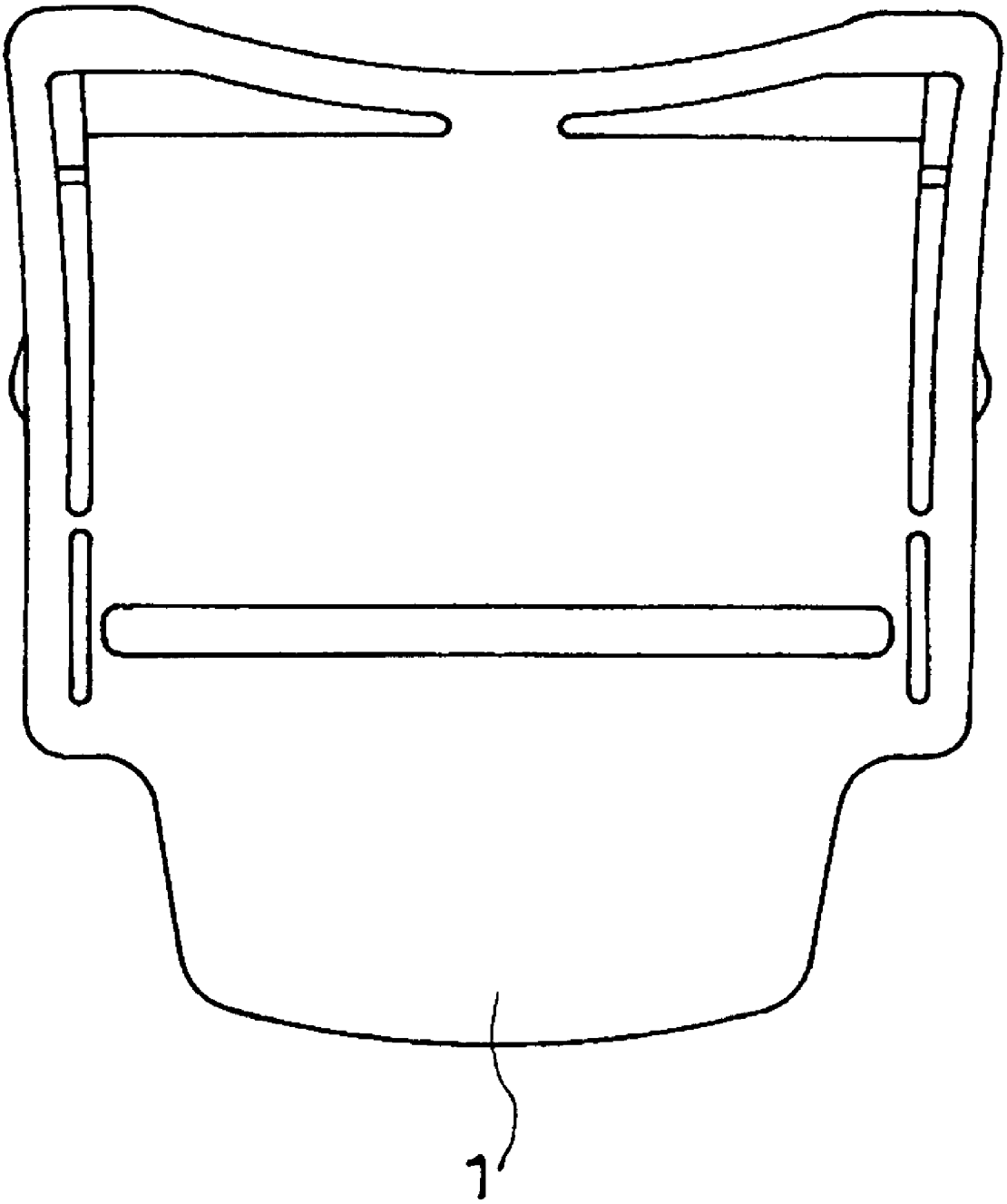
FIG. 8 is a bottom plan view of the buckle.
Figure 9:
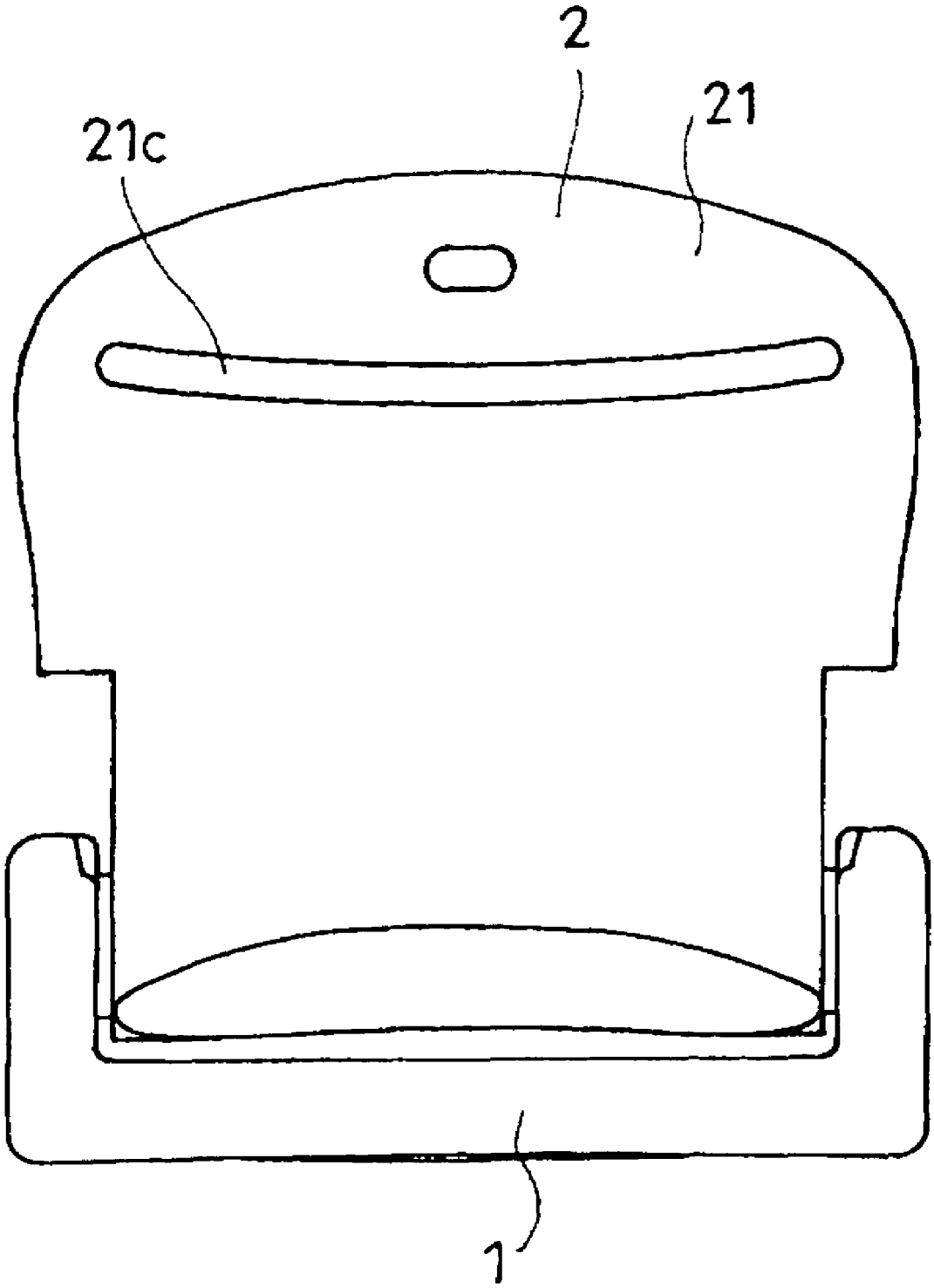
FIG. 9 is a front view of the buckle.
Figure 10:
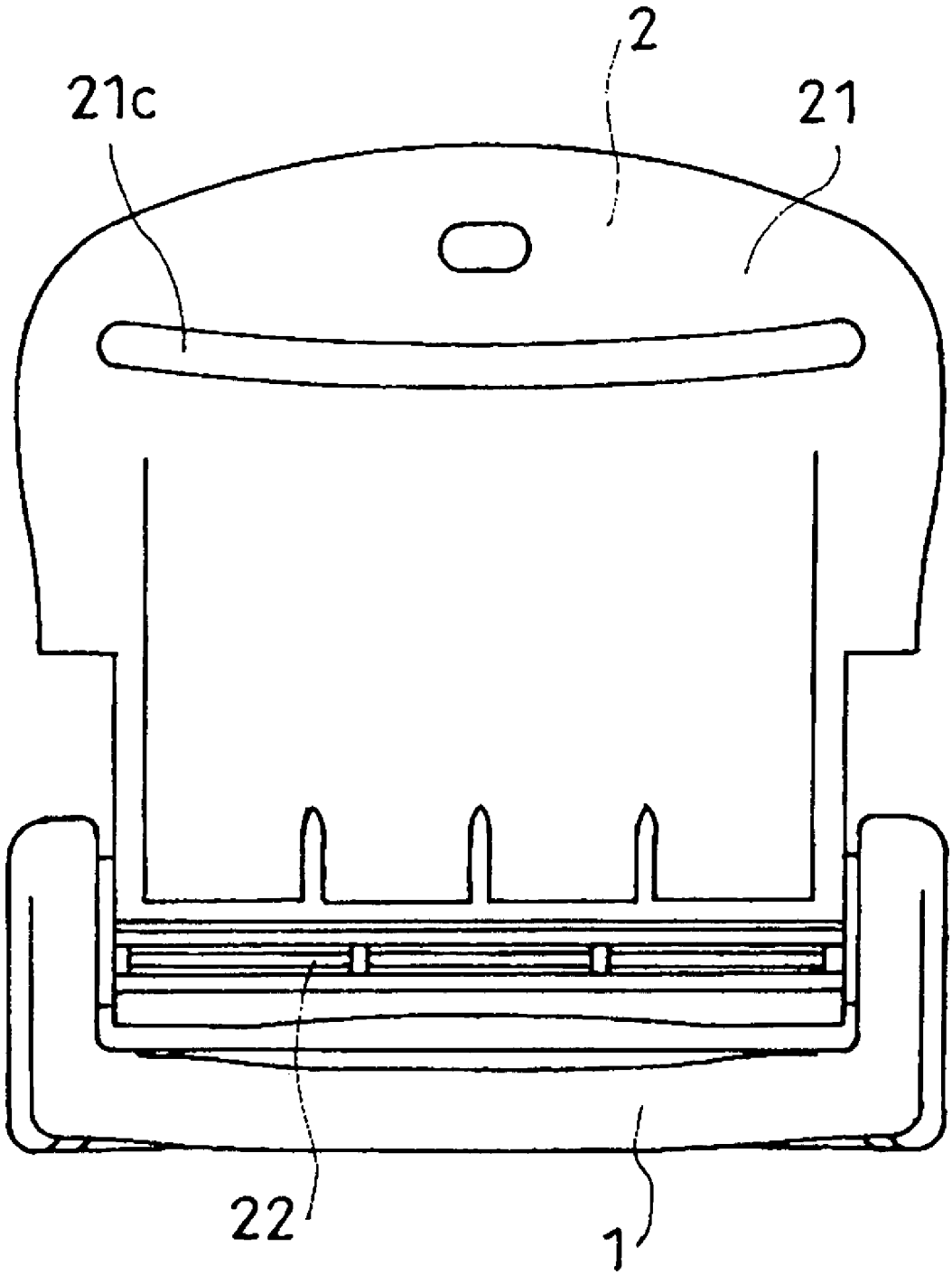
FIG. 10 is a rear view of the buckle.
Figure 11:
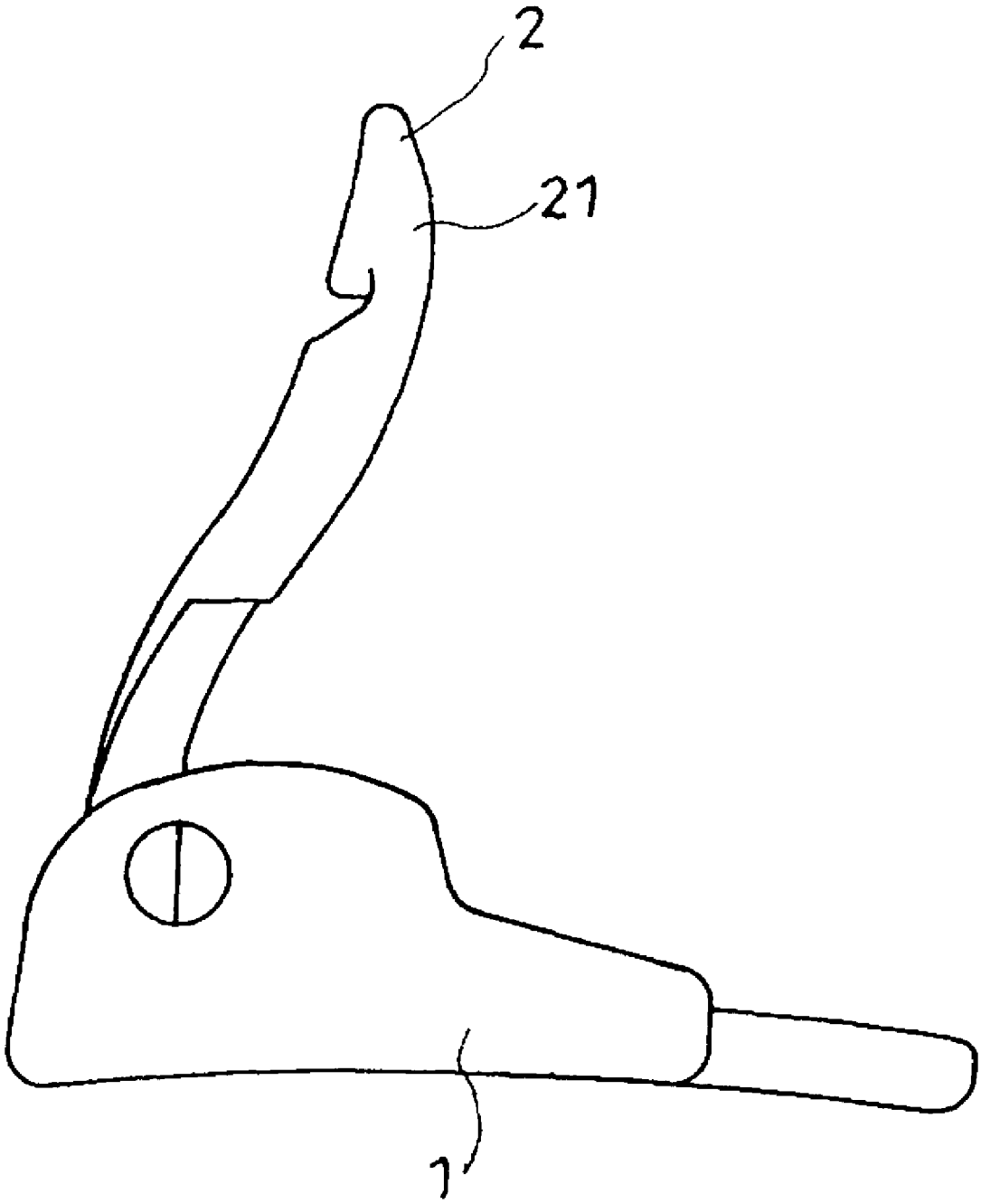
FIG. 11 is a right side view of the buckle.
Figure 14:
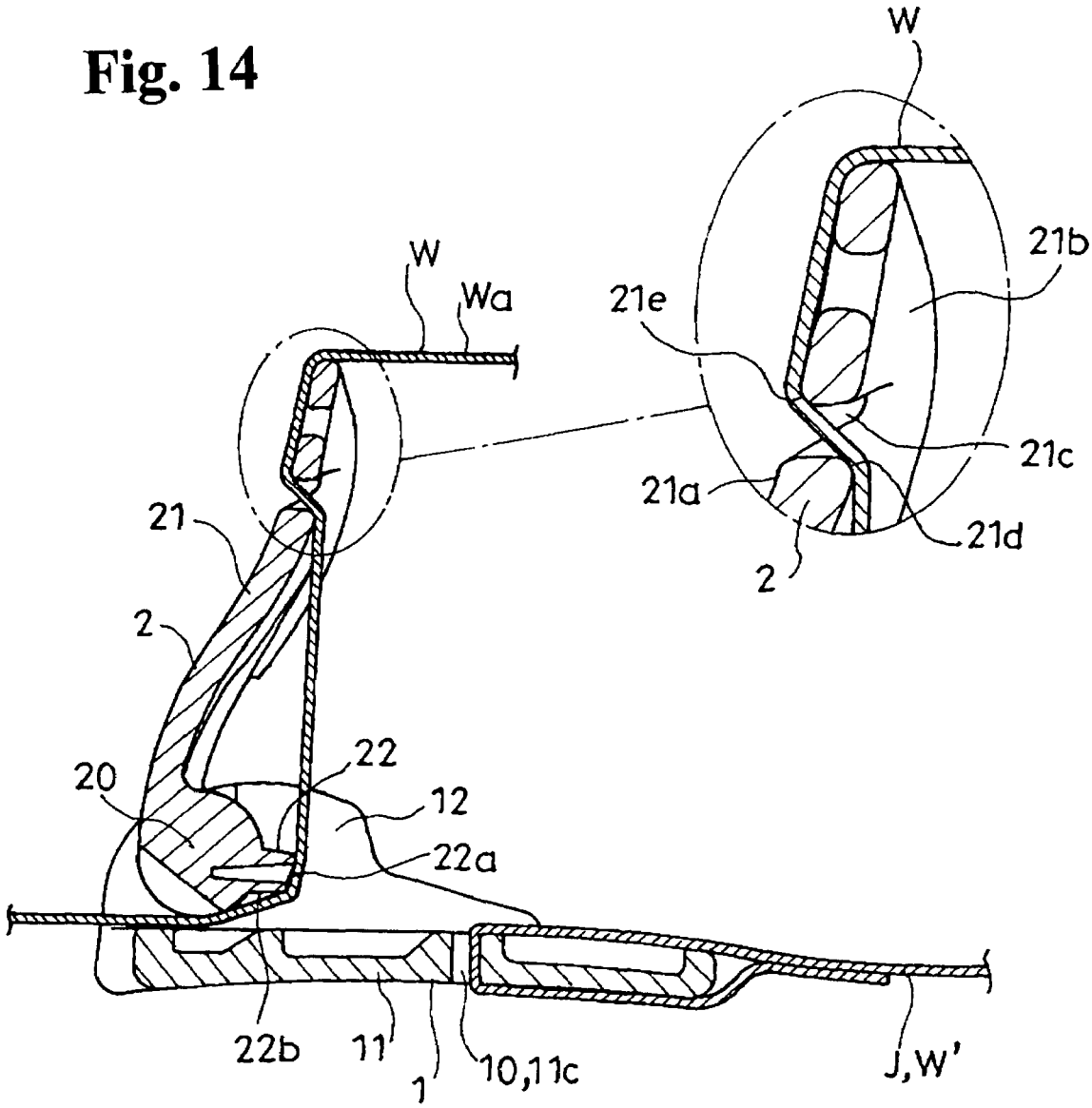
FIG. 14 is a sectional view illustrating a used state of the buckle.

FIGS. 1~6 illustrate a buckle in a state wherein a lever member 2 is laid down, and FIGS. 7~12 illustrates the buckle in a state wherein the lever member 2 is stood up. A left side view of the buckle is shown symmetrically relative to right side views of FIGS. 3, 11. Also, FIG. 13 shows a condition wherein band members W, W' are fastened through the buckle, and FIG. 14 shows a condition wherein the lever member 2 is stood up from the state in FIG. 13.

Figure 15:
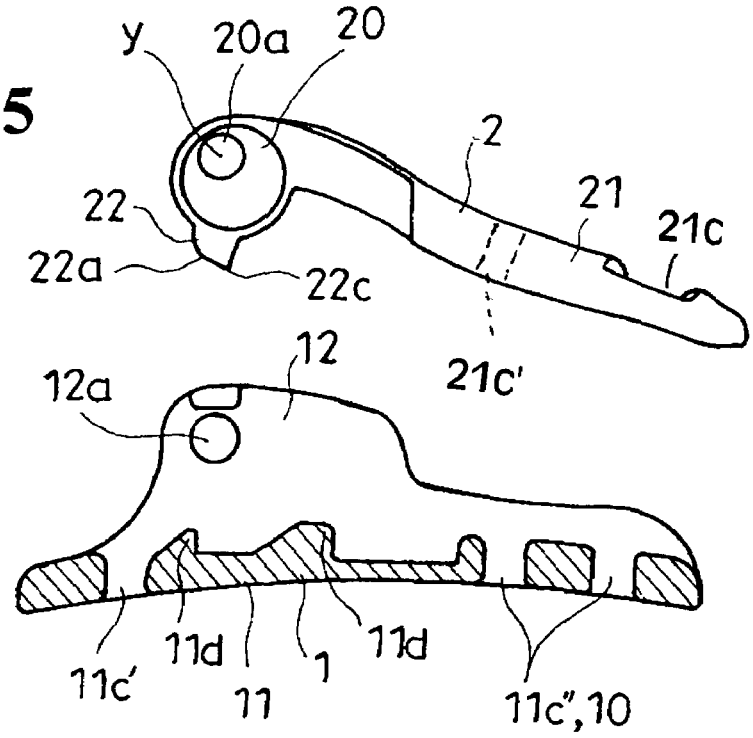
FIG. 15 is an exploded side view, in partially section, of essential parts of the buckle with respect to other constitutional examples.
Figure 16:
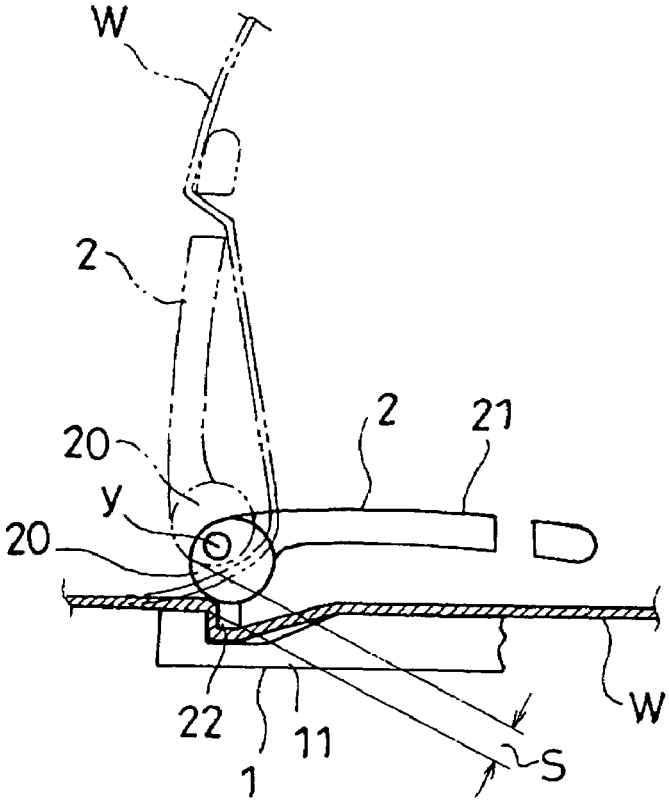
FIG. 16 is an explanatory view showing the function of the buckle shown in FIG. 15.

Also, FIG. 15 illustrates one example wherein a part of the structure of the buckle, shown in FIGS. 1~14, is changed to a state wherein a base 1 and the lever member 2 are separated. FIG. 16 illustrates a structural overview of the buckle as a model seen from a side view, so that the function of the buckle of the example can be easily understood. In FIG. 16, the shape when the lever member 2 is stood up is shown by imaginary lines.

The buckle of the embodiment is used for connecting an end portion side of the band member W relative to the other end portion side of the band member W; another band member W'; or a connected member J such as an item main body through the buckle in a state wherein a fastened position can be adjusted.

The buckle comprises base 1 and lever member 2.

The base 1 includes an attaching portion 10 of the connected member J. For example, if the base 1 is attached to the other band member W' by the attaching portion 10 of the base 1, two band members W, W' will be able to be connected through the buckle. Also, if the base 1 is attached to one end portion side of the band member W by the attaching portion 10 of the base 1, both end portions of the band member W will be able to be connected through the buckle. Also, if the base 1 is attached to a band main body and the like by the attaching portion 10 of the base 1, the band member W will be connected to the band main body and the like through the buckle.

The base 1 includes a base portion 11 and supporting portions 12 of the lever member 2 projecting from the base portion 11. In the example shown in the figures, the base portion 11 is arranged in such a way as to be in the form of a plate including the supporting portions 12 in opposing side portions. One side portion 11*a*, without supporting portions 12, is curved in such a way as to head in a medial direction to the base portion 11 as the side portion 11*a* approached the roughly intermediate position of the length direction of the side portion 11*a*.

The supporting portions 12 are arranged in a form of a side plate protruding in a direction perpendicular to one face of the base portion 11. The supporting portions 12 start in corners wherein the curved side portion 11*a* and sides, wherein the supporting portions 12 are formed, are contacted with each other and end by reducing the protruding size from the middle. The base portion 11 includes a tongue piece portion 11*b* protruding in front from the end places of the supporting portions 12. Shaft holes 12*a* passing through the supporting portions 12 are formed on the corner side of the supporting portions 12. Also, a penetrating slit 11*c*, ranging between the pair of supporting portions 12, is formed on the bottom side of the tongue piece portion 11*b* of the base portion 11. In the example shown in the figures, the base 1 is attached to the band member W' by passing the band member W' through the slit 11*c* and putting the band member W' around the tongue piece portion 11*b* of the base 1. More specifically, in the example shown in the figures, the slit 11*c* functions as the attaching portion 10.

The lever member 2 is rotatably assembled to the base 1. The lever member 2 includes an operating portion 21 extending from a combined or assembled portion 20, and a clamping portion 22 protruding from the combined portion 20 in a different direction from the operating portion 21. The operating portion 21 comprises the form of a plate with a size nearly covering one side of the base 1. The clamping portion 22 extends one side portion of the operating portion 21, and is formed in such a way as to protrude from the one side portion.

The clamping portion 22 protrudes from the operating portion 21 in a direction roughly perpendicular to the inner face of the operating portion 21. In addition, shaft projections 20*a* are respectively formed on a pair of face portions in the direction of the wall thickness of the lever member 2 in a place wherein the operating portion 21 and clamping portion 22 are united. During assembly, one of the shaft projections 20*a* of the lever member 2, is put into one of the shaft holes 12*a* of a pair of supporting portions 12, 12 of the base 1, and the other shaft projection 20*a* is put into the other shaft hole 12*a*, so that the shaft projections 20*a* are rotatably connected to the base 1.

More specifically, the connecting place between the operating portion 21 and the clamping portion 22 functions as the combined portion 20. Guiding grooves 12*b* are formed between protruded ends of the supporting portions 12 of the base 1 and the shaft holes 12*a*, and inclined surfaces 20*b* are formed on end portions facing the protruded side of the clamping portion 22 of the shaft projections 20*a* of the lever member 2.

As previously described, lever member 2 is rotatebly attached to base 1. By pushing lever member 2 between the pair supporting portions 12, 12 a space between the pair of supporting portions 12, 12 of the base 1 is elastically pushed and stretched by using the guiding grooves 12*b* and inclined surfaces 20*b*. Thus, the lever member 2 is positioned to where the shaft projections 20*a* are pushed into the shaft holes 12*a*, attaching the lever member 2 to the base 1.

The distance between the shaft projections 20*a* of the lever member 2 and a protruded end 22*a* of the clamping portion 22 is made slightly smaller than the distance between the shaft holes 12*a* and one face of the base portion 11 directly under the shaft holes 12*a* formed on the supporting portions 12 of the base 1. Two ribs 11*d*, 11*d* are formed on the base portion 11 of the base 1, and are arranged between the pair of supporting portions 12, 12 with a space just under the shaft holes 12*a*. When the lever member 2 is laid down, as described below, the clamping portion 22 of the lever member 2 is positioned in such a way that the protruded end 22*a* is inserted between ribs 11*d*.

At this time, a clamped space S, which is narrower than the thickness of the fastening band member, is formed between the two ribs 11*d* and the protruded end 22*a* of the clamping portion 22. (FIG. 4) The inner face of the rib 11*d*, which is located on the formational side of the tongue piece portion 11*b* of the base 1, becomes a sloping surface 11*e* that slopes in a direction such that the size of the rib gradually widens as the inner face of the rib 11*d* advances to the bottom from the top of the rib 11*d*.

Furthermore, an outer surface 22*b* of the clamping portion 22 follows an outer surface 20*c* of the combined portion 20 of the lever member 2 and is curved similar to a curve of the side portion 11*a* of the base 1. Also, the operating portion 21 of the lever member 2 has a wide tip side and narrow bottom side. When the lever member 2 is laid down, both edges of the wide part of the lever member 2 contacts the lowered upper surfaces of parts 12*c* of supporting members 12 of the base 1.

From the state wherein the lever member 2 is stood up, i.e., wherein an inner surface 21*b* of the operating portion 21 of the lever member 2 is distanced from the base portion 11 of the base 1, the lever member 2 is rotated and laid down, i.e., rotated to the position wherein the inner surface 21*b* of the operating portion 21 of the lever member 2 is adjacent and faced to the base member 11 of the base 1. Thereby, the band member W, which is passed through the base portion 11 of the base 1 and the combined portion 20 of the lever member 2, is clamped between the clamping portion 22 of the lever member 2 and the base portion 11 of the base 1.

When the lever member 2 is stood up, a space, which is wider than the thickness of the band member W, between the outer surface 22*b* of the clamping portion 22 and one side of the base portion 11, is formed. In the state wherein the lever member 2 is stood up, by using the space, the band member W, arranged between the base 1 and lever member 2 can pass through the buckle.

Also, a slit 21*c* is formed in the operating portion 21 of the lever member 2, through which the band member W, which is long in a rotational shaft line X direction of the lever member 2, passes.

A strip of slit 21*c* is provided on the tip side of the operating portion 21 of the lever member 2, i.e., on the side opposite to the connecting side to the clamping portion 22, and passes through the inside and outside of the operating portion 21. The width of the slit 21*c* is roughly equal or slightly larger than the wall thickness of the band member W that is passed through.

Also, the slit 21*c* is formed in such a way as to form an arc in the length direction.

More specifically, the slit 21*c* is curved in an arc shape in such a way that the bottom side of the lever member 2, i.e., the connecting side with the clamping portion 22, becomes the curved outside of the slit 21*c*.

Furthermore, a face of the place in which the slit 21*c* of the operating portion 21 of the lever member 2 is formed, has a curved face with a curved center of the central part of the slit 21*c*.

More specifically, FIG. 14 illustrates wherein both the inner surface 21*b* and an outer surface 21*a* of the tip sides of the operating portion 21 of the lever member 2 have curved faces. As the inner surface 21*b* and outer surface 21*a* move toward the center of the lever member 2, the inner surface 21*b* is curved in such a way as to gradually approach the outer face side, and the outer surface 21*a* is curved in such a way as to gradually hang over the outward.

From the state wherein the lever member 2 is stood up, the band member W, which is passed through between the lever member 2 and base 1, is pulled out of an inner surface 21*b* side of the operating portion 21 to an outer surface 21*a* side of the operating portion 21 through the slit 21*c* provided in the operating portion 21. As described above, by laying the lever member 2 down from the state wherein the band member W is pulled out, the band member W is clamped between the clamping portion 22 and base portion 11 of the base 1 and is thereby fastened. This fastened state is released by standing the lever member 2 up.

However, even in the stood up state, the band member W can be hung over outward from the outer surface 21*a* side of the operating portion 21 through the slit 21*c*. At this time, when a force in the direction of slipping through the slit 21*c* acts on the band member W, or a force in the direction of allowing the band member W to slip through the slit 21*c* acts on the buckle, or the above-mentioned forces act on both the band member W and buckle, the band member W makes contacts with the protruded end 22*a* of the clamping portion 22; an edge portion 21*d* on the inner surface 21*b* side of the operating portion 21 in the slit 21*c*; and an edge portion of an outer surface 21*e* side of the operating portion 21 in the slit 21*c*. (FIG. 14) As a result, in the case that the above-mentioned forces act on the band member W and the like when the lever member 2 is stood up as shown in FIG. 14, a force in the direction of laying down the lever member 2 acts on the lever member 2. By the action of this force, the lever member 2 is rotated for at least a predetermined angle toward the direction wherein the lever member 2 is laid down.

Accordingly, when the lever member 2 is rotated, the band member W is clamped between the protruded end 22*a* of the clamping portion 22 and the base portion 11 of the base 1. As a result, the band member W is prevented from slipping through between the lever member 2 and base 1, thereby preventing the band member W and buckle from being unpredictably separated. Also, by holding the band member W, which is pulled out of the slit 21*c*, and moving a pulled-out portion Wa closer to the base portion 11 of the base 1, the lever member 2 can be rotated to the position of being laid down using one hand, and the band member W fastened state can be made at the flip of a switch.

Furthermore, the slit 21*c* is formed in an arc shape in the length direction such that the face of the operating portion 21 forming slit 21*c* is curved with the curved center of the central part of the slit 21*c*. Therefore, the edge portion of the slit 21*c* can be strongly contacted with the central part of the band member W, which is tensed by the force in at least one of the inner surface 21*b* side and the outer surface 21*a* side of the operating portion 21. Also, in the other side of the inner surface 21*b* side and the outer surface 21*a* side of the operating portion 21, the slit 21*c* can be strongly contacted with the edge portion side of the band member W which is tensed as mentioned above. Therefore, the lever member 2, which is stood up when the force is applied, is steadily rotated in the direction of laying the lever member 2 down.

On the outer surface 21*a* side of the operating portion 21 of the lever member 2, the edge portion, which is located on the tip side of the operating portion 21 of the slit 21*c*, is contacted with the central part of the band member W. Accordingly, the band member W is linearly urged in the width direction by being tensed by said force. Also, the edge portion, which is located on the bottom side of the operating portion 21 of the slit 21*c*, is allowed to contact both edge portions of the band member W in the inner surface 21*b* side of the operating portion 21 of the lever, respectively.

In another embodiment, two slits (21*c*, 21*c*' in FIG. 15) may be formed in a protruding direction of the operating portion 21 of the lever member 2, such that the band member W, with a long rotational shaft along an X line of the lever member 2, is allowed to pass through.

In this case, the band member W, passing between the lever member 2 and base 1, is passed through one of the two slits from the inner surface 21*b* side of the operating portion 21 of the lever member 2, and pulled out to the outer surface side of the operating portion 21. After that, the band member W can be re-pulled out to the inner surface 21*b* side of the operating portion 21 through the other of the slits. Even in this case, the lever member 2, which is stood up when the force is acted, is rotated in a direction of being laid down. Accordingly, the band member W can be prevented from slipping through between the lever member 2 and base 1.

FIG. 15 illustrates wherein the rotational center of the lever member 2, in the state wherein the lever member 2 is laid down, is located on the upper side of the clamping portion 22, and lopsidedly inclined toward the opposite side of the extended side of the operating portion 21, rather than right above the clamping portion 22.

In this example, the two ribs 11*d*, 11*d* are formed directly underneath the shaft hole 12*a* formed in the supporting portion 12 in the base 1, and a slit 11*c*', with a length arranged between both supporting portions 12, 12 is provided in a place wherein one of the two ribs 11*d*, 11*d* is adjoining. Also, two slits 11*c*", which become attaching portions 10 are spaced apart from the other two ribs 11*d*, 11*d* and the other of the side portions wherein the supporting portion 12 is not formed in the base 1.

In this example, the protruded end 22*a* of the clamping portion 22 has a sloping surface formed in such a way wherein the protruded size gradually increases toward the protruded side of the operating portion 21. In this example, the center of the shaft projection 20*a* with a short cylinder shape formed in the lever member 2 is located lopsidedly inclined toward the opposite side of the extended side of the operating portion 21 rather than right above the lower end 22*c* of the sloping surface.

As mentioned above, when the lever member 2 is formed, a space S, allowing the band member W to pass through between the base portion of the base 1 and the combined portion 20 of the lever member 2, can be made as large as possible in the state wherein the lever member 2 is stood up.

At the same time, in the state wherein the lever member 2 is laid down, the band member W, passed through by narrowing an interval between the clamping portion 22 and base portion 11 of the base 1, can be solidly clamped between both the clamping portion 22 and base portion 11 of the base 1. (FIG. 16) More specifically, in the state wherein the lever member 2 is stood up, the band member W can easily pass through between the base portion 11 of the base 1 and the combined portion 20 of the lever member 2. Also, even if the band member W becomes thicker to some extent, the band member W can be fastened to the lever member 2 through the space S. Also, when the lever member 2, which is laid down, is stood up and released from being fastened to the band member W, the clamping portion 22 is pressed against the band member W in this rotating tip side of the lever member 2, rather than directly underneath the rotational center of the lever member 2. Therefore, the lever member 2 can be stood up by relatively small force.

Disclosures of Japanese Patent Applications No. 2006-307007, filed on Nov. 13, 2006, and No. 2006-103152, filed on Apr. 4, 2006, are incorporated by reference herein in their entirety.

While the invention has been explained with reference to the specific embodiments of the invention, the explanation is illustrative and the invention is limited only by the appended claims.

What is claimed is:

1. A buckle for connecting a band member to a connected member comprising:

a base including a base portion, an attaching portion to the connected member, formed in the base portion, and opposing lever member supporting portions projecting from the base portion; and a lever member rotatably attached to the base, the lever member including an assembled portion, an operating portion extending from the assembled portion, and a clamping portion protruding from the assembled portion in a direction different from the operating portion, the clamping portion being configured to clamp the band member passing between the base portion and the assembled portion, to the base portion of the base by a rotation of the lever member towards the base, wherein the operating portion of the lever member includes a tip portion with curved inner and outer surfaces arranged such that as the inner surface and outer surface move towards a center of the lever member, the curved inner surface gradually approaches the outer surface, and the curved outer surface is arranged to gradually hang over an outward portion of the tip portion;

wherein the operating portion of the lever member includes an arcuic slit in a length direction through which the band member is allowed to pass, such that the curved outer surface of the operating portion of the lever member is curved with a curved central part of the slit, whereby a tip side edge portion of the slit and an edge portion on the assembled portion side of the slit are configured to be strongly contacted with a central portion of the band member tensed by a force in at least one of the inner surface and outer surface of the operating portion of the lever member, such that the lever member is configured to be rotated from a stood up position to a laid down position when the force is applied; and wherein the operating portion of the lever member has, where the slit is formed, a curved face curved relative to a center of the slit.

2. A buckle according to claim 1, wherein two slits are formed in a protruding direction of the operating portion of the lever member, the two slits being arranged to allow the band member to pass through.

3. A buckle according to claim 1, wherein the lever member includes a rotational center located on an upper side of the clamping portion in a clamping position of the lever member, and biased at a side opposite to an extended side of the operating portion.

4. A buckle according to claim 1, wherein said base portion includes a groove in which the clamping portion is disposed in a clamping position of the lever member.

* * * * *